United States Patent [19]

Moyer

[11] Patent Number: 4,736,668

[45] **Date of Patent: * Apr. 12, 1988**

[54] BRAIDER CARRIER

[75] Inventor: James D. Moyer, Downingtown, Pa.

[73] Assignee: Raychem Corporation, Menlo Park, Calif.

[ * ] Notice: The portion of the term of this patent subsequent to Oct. 28, 2003 has been disclaimed.

[21] Appl. No.: 884,568

[22] Filed: Jul. 11, 1986

Related U.S. Application Data

[63] Continuation-in-part of Ser. No. 759,533, Jul. 26, 1985, Pat. No. 4,619,180.

[51] Int. Cl.[4] ..... D04C 3/16; D04C 3/02

[52] U.S. Cl. ..... 87/57; 87/21; 87/55; 87/56; 87/61; 242/156.2

[58] Field of Search ..... 87/55–57, 87/20–22, 61, 48; 242/156, 156.2

[56] References Cited

U.S. PATENT DOCUMENTS

| | | | |
|---|---|---|---|
| 1,541,792 | 6/1925 | Connolly | 87/55 X |
| 1,614,099 | 1/1927 | Blaisdell | 87/55 |
| 1,630,669 | 5/1927 | Mossberg | 87/22 |
| 2,049,385 | 7/1936 | Krissier | 87/55 |
| 2,079,570 | 5/1937 | Janssen | 87/21 X |
| 2,167,930 | 8/1939 | Krissier | 87/21 X |
| 2,336,776 | 12/1943 | Carter | 87/57 |
| 2,459,617 | 1/1949 | Carter | 87/57 X |
| 2,911,875 | 11/1959 | Ostermann et al. | 87/21 |
| 3,756,533 | 9/1973 | De Young | 242/156.2 |
| 3,802,643 | 4/1974 | De Young | 242/156 |
| 3,817,147 | 6/1974 | Richardson | 87/57 |
| 3,839,939 | 10/1974 | Wily | 87/57 |
| 3,882,757 | 5/1975 | Weatherby | 87/57 |
| 4,380,949 | 4/1983 | Betta | 87/48 |

FOREIGN PATENT DOCUMENTS

| | | |
|---|---|---|
| 864605 | 1/1953 | Fed. Rep. of Germany . |
| 939527 | 2/1956 | Fed. Rep. of Germany . |
| 2134550 | 8/1984 | United Kingdom . |

*Primary Examiner*—John Petrakes

*Attorney, Agent, or Firm*—Timothy H. P. Richardson; Herbert G. Burkard

[57] ABSTRACT

A braider carrier for wide ribbon and/or composite strand is disclosed. The braider carrier guide pulley assembly includes a support, a pulley frame operatively, pivotly mounted to the support, a generally cylindrical guide pulley operatively, rotatably mounted to the pulley frame to accommodate movement of the carrier during the braiding operation, openings through the support and pulley frame at the point of pivot and aligned with the guide pulley, a delivery eye operatively connected to the pulley frame, the eye and the openings capable of holding strand to be braided against the cylindrical surface of the pulley preventing the strand to be braided from twisting during the braiding operation which pivots the pulley frame. The braider carrier bobbin assembly utilizes a magnetic clutch and a torsion spring, the spring capable of providing slack control of strand to be braided and the clutch capable of providing tensioned feed of strand as strand is wound off of the bobbin. In lieu of the braider carrier guide pulley assembly, there may be inserted a twist compensator article.

9 Claims, 3 Drawing Sheets

BRAIDER CARRIER

RELATED APPLICATION

This application is a continuation-in-part of U.S. patent application Ser. No. 759,533, filed July 26, 1985, now U.S. Pat. No. 4,619,180, entitled "Braider Carrier", which is incorporated herein by reference.

BACKGROUND OF THE INVENTION

1. Field of the Invention

The invention relates to textile fabricating machinery, and more particularly to improvements in the construction of strand carriers for braiding machines and the like.

2. Prior Art

In the past braiding carriers have been developed for the production of fabric on braiding machines which require that strand or strands be fed to a braiding point from carriers which are actuated along a sinuous path formed in the race plate of the machine. These machines were designed primarily to braid strands of relatively flexible material such as fine yarn. Carriers used on these machines are sometimes called "Maypole"-type carriers. Typical carriers of this type are disclosed in U.S. Pat. Nos. 2,167,930, 2,336,776, and 2,459,617 which are incorporated herein by reference.

Advances in fiber technology have led to the development of new high modulus filaments or fibers. Graphite or carbon, boron and Kevlar (a trademark of E. I. DuPont de Nemours and Company) fibers are examples of these new fibers. Such new fibers are now incorporated into reinforced composite strands of the thermoset and thermoplastic type. These reinforced composite strands present new problems not encountered by braiding carriers disclosed above. For example when new strand materials are fabricated into a composite flat ribbon, such a ribbon is flexible only along one axis. Known carriers are wholly inadequate to handle the braiding of such still ribbons/strands. Specifically, the prior art devices fail to disclosed mechanisms for holding and orienting the wide ribbons firmly and accurately in position long enough during the braid forming operation without twisting to ensure its firm retention by subsequently laid strands.

Braiding equipment discussed above also operates with the carriers in a vertical plane whereby gravity is available for purposes of tensioning the strand to be braided that is wound on a bobbin. It is highly desirable to have the braider carriers capable of operating in a horizontal as well as the vertical plane wherein the weighted mechanisms for tensioning are not functional. Prior art devices also show the use of tensioning devices in the form of brakes which are held in position by level mechanisms and/or springs. Such devices are also designed for a vertical operation and are generally too awkward and burdensome to adapt to a horizontal movement. Moreover, these types of gravity dependent, or linkage-level mechanisms are generally unsuitable for the reinforced composite strand which is sticky, tacky, and therefore unpredictably difficult to unwind as compared to strands of flexible materials such as fine yarn for which they were designed.

The instant invention provides mechanisms which will tension a bobbin regardless of the directional orientation of the carrier itself and regardless of the tackiness of the strand on the bobbin. The instant invention accomplishes this by maintaining the orientation of the flat ribbon against a generally cylindrical pulley, not taught by the prior art and/or by providing bobbin tension through the combination of a magnetic clutch and a torsion spring.

SUMMARY OF THE INVENTION

The purpose of the instant invention is to provide a carrier to handle strand in the form of flat ribbon which is primarily flexible along one axis and/or to handle strand which is tacky and difficult to tension, said carrier being capable of operating in both the vertical and horizontal orientations. To accomplish this purpose there is provided a braider carrier guide pulley assembly which maintains strand in the form of wide flat ribbon against a rotating generally cylindrical surface regardless of the movement of the braider carrier. There is also provided a braider carrier bobbin assembly which maintains tensioned feed and slack control by the use of a magnetic clutch means and torsion spring means.

In one aspect of the invention there is provided a braider carrier guide pulley assembly for wide ribbon strand, said assembly comprising:

a support having a first opening therethrough to receive strand to be braided, said first opening having an axis therethrough normal to said first opening and generally coincident with the longitudinal axis of strand to be braided and being defined as the strand axis;

a pulley frame operatively pivotly mounted to said support about said strand axis and having a second opening therethrough concentric with said strand axis;

a cylindrical guide pulley operatively rotatably mounted to said pulley frame and having a axis of rotational normal to the strand axis, the pulley having a generally cylindrical surface that is tangent to said strand axis; and, a delivery eye operatively connected to said pulley frame and in alignment with said pulley to guide a strand to be braided to a braiding point, said eye and said first and second openings capable of holding strand to be braided against said cylindrical surface of said pulley preventing strand to be braided from twisting while said pulley frame pivots during a braiding operation.

Another aspect of the invention is a braider carrier bobbin assembly comprising:

a frame;

a standard extending from said frame;

a bobbin rotatably mounted on said standard, said bobbin having end flanges;

magnetic clutch means rotatably mounted on said standard, said clutch means magnetically engaging at least one end flange of said bobbin to resist a rotation of said bobbin relative to said clutch means; and, torsion spring means mounted about said standard and operatively interconnected between said magnetic clutch and said frame, said spring means resisting and limiting rotation of said clutch means, said spring means capable of providing slack control of strand to be braided and said clutch means capable of providing tensioned feed of strand to be braided as strand may be wound off of said bobbin.

Yet another aspect of the invention is a braided carrier comprising:

a frame;

a standard extending from said frame;

a bobbin rotatably mounted on said standard, said bobbin having end flanges;

magnetic clutch means rotatably mounted on said standard, said clutch means operatively magnetically engaging at least one end flange of said bobbin to resist rotation of said bobbin relative to said clutch means;

torsion spring means mounted about said standard and operatively interconnected between said magnetic clutch means and said frame, said spring means resisting and limiting rotation of said clutch means, said spring means capable of providing slack control of a strand to be braided and said clutch means capable of providing tension feed of strand to be braided as strand may be wound off of said bobbin;

a support operatively connected to said frame, said support having a first opening therethrough to receive strand to be braided from said bobbin, said first opening having an axis therethrough to receive strand to be braided from said bobbin, said first opening having an axis therethrough normal to said first opening and generally coincident with the longitudinal axis of strand to be braided and being defined as the strand axis;

a pulley frame operatively pivotly mounted to said support about said strand axis and having a second opening therethrough concentric with said strand axis;

a cylindrical guide pulley operatively rotatably mounted to said pulley frame and having a axis of rotation normal to the strand axis, the pulley having a generally cylindrical surface that is tangent to said strand axis; and, a delivery eye operatively connected to said pulley frame and in alignment with said pulley to guide a strand to be braided to a braiding point, said eye and said first and second openings capable of holding strand to be braided against said cylindrical surface of said pulley preventing strand to be braided from twisting while said pulley frame pivots during a braiding operation.

A further aspect of the invention relates to a twist compensator article. The article is operatively connected to the frame of the braider carrier. The twist compensator article has a leading edge arcuate portion operatively connected to a trailing portion of the twist compensator article. The leading arcuate and trailing portions have opposed surfaces which together define an arcuate opening for receiving a strand to be braided and preventing a strand to be braided from twisting during pivoting of the braider carrier.

DESCRIPTION OF THE PREFERRED EMBODIMENT

Figure 1:
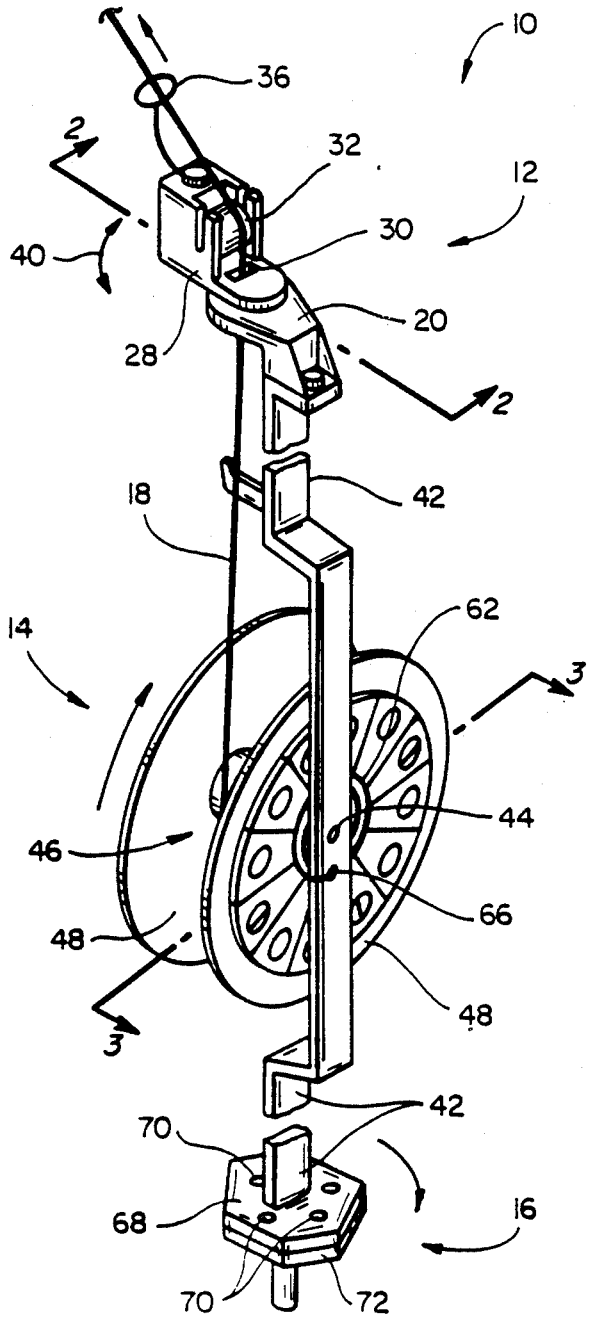
FIG. 1 is a partial perspective view of the carrier of the instant invention with the carrier oriented in a vertical direction.

With continued reference to the drawing wherein like parts are designed by the same reference numerals, FIG. 1 discloses the braider carrier 10 of the instant invention. Although the carrier 10 is shown to be vertically oriented, it is understood that the carrier is operational in the horizontal orientation and is preferably used with braiders whose carriers are arranged horizontally.

Braider carrier 10 includes the guide pulley assembly shown generally at 12, a carrier bobbin assembly shown generally at 14 and a raceway guide means shown generally at 16. These portions of the carrier are shown to be separated from each other to illustrate the included concept that adjacent carriers may have alternating high and low positioned bobbin assemblies, i.e. that the bobbin assembly may be interconnected by long or short frame segments, resulting in "high" and "low" braider carriers, respectively, which may be staggered in a machine for ease of operation.

Figure 2:
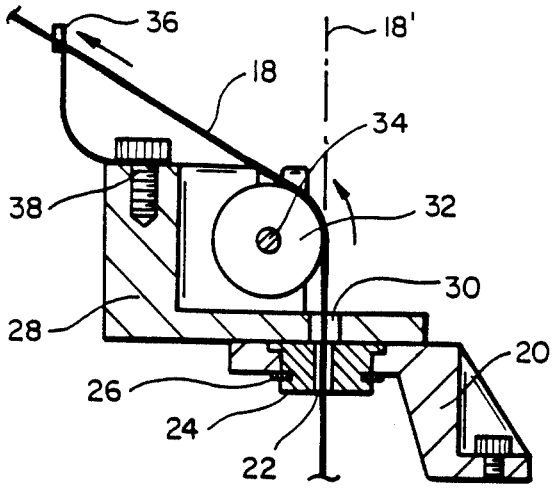
FIG. 2 is a cross-sectional view of the guide pulley assembly of the braider carrier taken along cross-sectional lines 2—2 in FIG. 1.

The braider carrier guide pulley assembly 12 is designed to handle strands having a wide range of cross-sectional geometries, but most especially to handle flat or wide ribbon strand, e.g., up to ½ inch in width of very stiff materials, and especially composite materials (hereinafter referred to merely as "strand"). Strand 18 shown in FIG. 1 is oriented to show the width of the strand as can be seen by comparison to FIG. 2, a side view, showing the strand 18 to be relatively narrow. Strand 18 is fed from bobbin assembly 14 into the guide pulley assembly 12 onward to a braiding point (not shown). A number of braider carriers of the type disclosed each supporting a bobbin of the material of which the braid is made move in serpentine tracks in opposite directions consecutively under the influence of a rotating mechanism, all as well known in the braiding art. As the carriers move, the strand 18 must be fed out by the guide pulley assembly and swing through as much as a 180° angle of rotation. The strand which is generally flexible only along one axis will tend to flip over in a conventional guide pulley assembly and if braided will destroy the integrity of the braid and will most likely fracture.

Guide pulley assembly 12 comprises a support 20 having a first opening 22 therethrough to receive strand 18 to be braided. First opening 22 has an axis through support 20 which is normal to said support 20, said axis being coincident with strand 18 to be braided, said axis is being hereinafter defined as the strand axis 18′ as noted in FIG. 2. Support 20, preferably further includes an insert 24 of low-friction material such as a fluoroplastic or nylon having the first opening 22 therethrough. Insert 24 is secured and integral with support 20 by a flange on the insert at one end and by a groove and lock ring 26 or the like at the other end.

A pulley frame 28 is operatively, pivotably mounted to the support 20, said pulley frame 28 pivotable through an angle of rotation of at least 180°, said pulley frame 28 pivotable about the strand axis 18′ during the braiding operation. It can be appreciated that the pulley frame may be spaced from support 20 and may be interconnected thereto by intermediate members (not shown) such as bearings, etc. Pulley frame 28 has a second opening 30 therethrough which is concentric about the strand axis 18′. Second opening 30 is seen in FIG. 1 to be rectangular in shape so to allow free movement of the strand 18 therethrough. It is understood that the word "opening" as used with both the first opening 22 and the second opening 30 may include various geometric shapes such as circular, oval, square, rectangular, etc., and said "openings" may be further open at their respective perimeters for purposes of threading, etc.

A cylindrical guide pulley 32 is operatively rotatably mounted to the pulley frame 28, said pulley having an axis rotation 34 normal to the strand axis 18'. The pulley 32 is mounted such that the generally cylindrical surface of the pulley is tangent to strand axis 18'. Guide pulley 32 may be spaced somewhat from frame 28 and interconnected by intermediate members such as bearings (not shown). The pulley 32 is preferably a right angled cylinder. It is within the scope of the invention to slightly increase the diameter of the pulley 32 at its midpoint to make it slight barrel shaped to enhance strand tracking. The surface of pulley 32 may also be modified in roughness to enhance tracking.

A delivery eye 36 to guide strand 18 to be braided to a braiding point (not shown) is operatively connected to pulley frame 28 by attachment means 38 and is in alignment with pulley 32, the eye being capable of holding the strand 18 to be braided against the cylindrical surface of the pulley 32, the surface capable of preventing the strand 18 from twisting while the pulley frame 28 rotates as noted at 40 in FIG. 1 during the braiding operation.

Braider carrier bobbin assembly 14 comprises a frame 42, a standard 44 extending from said frame (noted in FIG. 1 as a pivot point). It is understood that standard 44 extends generally perpendicular to frame 42 and may be integral therewith. Standard 44 is also illustrated in FIG. 3.

The assembly further includes a bobbin shown generally at 46 rotatably mounted on the standard 44, the bobbin having circular end flanges 48. A magnetic clutch means 50 is rotatably mounted on standard 44 between frame 42 and bobbin 46. The clutch means operatively magnetically engaging end flange 48 to resist rotation of bobbin 46 relative to the clutch means 50. It is within the scope of the invention to mount the clutch means outboard (not shown) of the bobbin 46. It can be understood that the clutch means is therefore capable of engaging more than one end flange.

Figure 3:
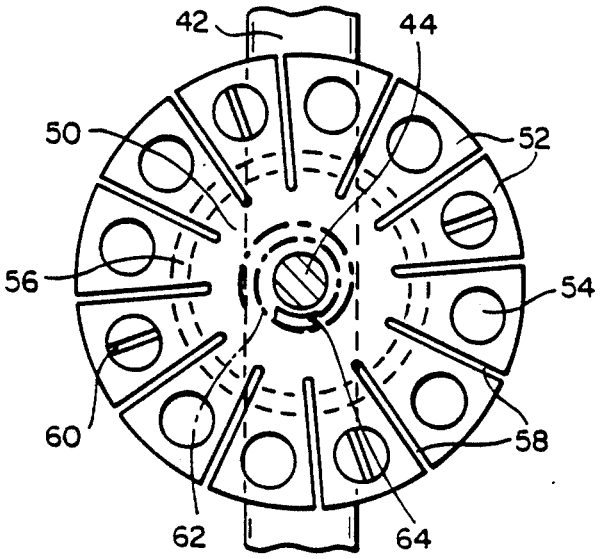
FIG. 3 is a side view of the magnetic clutch means of the bobbin assembly of the braider carrier taken along cross-sectional lines 3—3 of FIG. 1 with the torsion spring means shown in phantom.

The magnetic clutch means 50 is shown in FIG. 3, which is a view from the bobbin 46 looking toward frame 42. Magnetic clutch means 50 comprises a generally circular disc of low-friction material such as but not limited to nylon, the circumference separated said disc radially to define a plurality of radially projecting fingers 52 each having apertures 54, therein respectively. The disc is further thinned in its central portion as noted by indentation lines 56 to provide further flexibility to the fingers 52. It can be seen that open spaces 58 between the fingers 52 provide for some angular movement of the fingers 52 during rotation and useful during the start of rotation. The apertures 54 in the fingers 52 are configured to accommodate and secure magnetic elements 60. Generally, any number of desired elements 60 may be used. The greater the number of elements, the greater the amount of magnetic attraction to the bobbin and the greater the amount of rotational resistance. It is within the scope of the invention to use any suitable material having strong magnetic properties. It is understood that the end flange of the bobbin made from a material that will be attracted to and by the magnetic elements 60.

It is further within the scope of the invention to utilize a magnetic clutch means in the form cylindrical bearing (not shown) upon which the bobbin could be concentrically mounted.

Torsion spring means 62 in the form of a torsion spring as seen in FIG. 1 and as shown in phantom in FIG. 3 is mounted about standard 44 between and operatively interconnected between and in a suitable fashion to magnetic clutch means 50 such as at point 64 and the frame 42 such as at point 66. If the clutch means was mounted, as noted earlier, outboard of bobbin 46 then the torsion spring means would be connected at one end to the clutch means and at the other end to the standard 44 which is attached to the frame, the torsion spring means thus operatively interconnected between the magnetic clutch means and the frame. Likewise a cylindrical bearing-type magnetic clutch means would be connected to the torsion spring means which would in turn be connected to the standard or frame. Spring means 62 resists and limits rotation of the magnetic clutch means 50. The spring means is therefore capable of providing slack control of strand 18 to be braided and the magnetic clutch means 50 capable of providing tensioned feed of strand 18 to be braided as the strand is wound off of the bobbin 46. It is understood that as the bobbin unwinds the strand 18, the torsion spring means 62 will be wound tighter, preferably is wound to 360° of rotation before it can be wound no further and locks up. Further rotational movement of the bobbin causes the magnetic clutch means (specifically the magnetic elements 60) to slip with respect to the end flange of the bobbin. Torsion spring means 62 will then partially unwind and provide a dynamic slack control. It is understood that various mechanical expedients such as bending the ends of spring means 62, clamps, etc., may be employed to connect spring means 62 at points 64 and 66.

FIG. 1 also illustrates raceway guide means 16 operatively connected to the support 20, the raceway guide means 16 connectable to the sinuous track inn the raceplate of a braiding machine (not shown), said raceway guide means 16 being angularly adjustable about the strand axis 18'. Raceway guide means 16 comprises an extension of frame 42 in the form of a plate 68 having equally spaced openings 70 therethrough. Four such openings are shown, but it is understood that it is within the scope of the invention to provide any number of openings or to vary the spacings of the openings to allow angular realignment of plate 68 and all earlier described portions of the carrier with respect to the raceway guide means pin plate 72. Plate 68 is thus connected such as by bolts or the like to pin plate 72. It is understood that the importance of the raceway guide means is the ability to re-align the entire braider carrier for the smooth and even distribution of strand.

Figure 4:
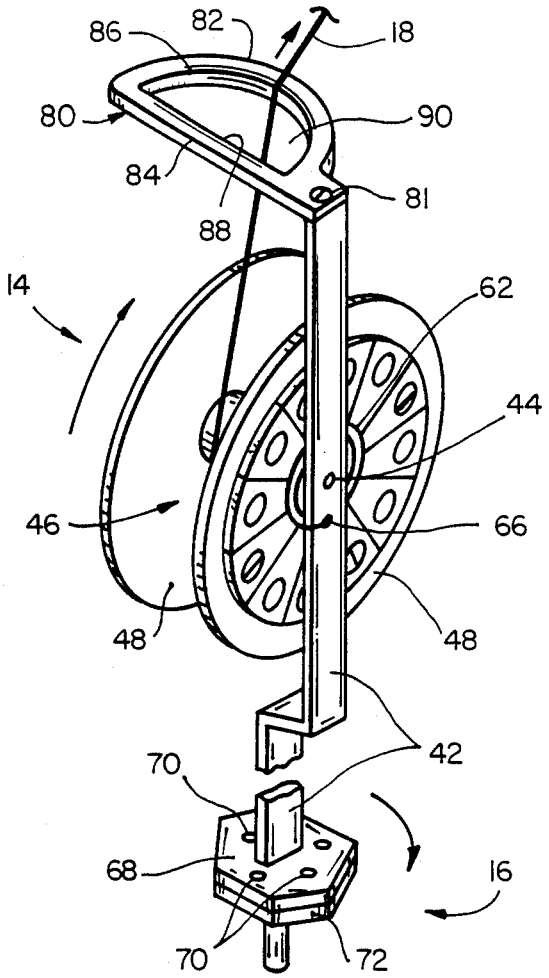
FIG. 4 is a partial perspective view of the carrier of the instant invention with the carrier oriented in a vertical direction and further illustrating the twist compensator article of the instant invention.

Referring now to FIG. 4 there is shown another embodiment of the braider carrier according to the invention. As discussed previously the braider carrier comprises a frame 42, a standard 44 extending from said frame, and a bobbin 46 rotatively mounted on said standard. Now the braider carrier further comprises in lieu of the guide pulley assembly discussed previously a twist compensator article 80. The twist compensator article 80 is operatively connected to the frame 42. The means of connection between the twist compensator article and the frame are unimportant to the invention. However a convenient means of connecting the twist compensator article and the frame is by screw 81. The twist compensator article 80 has a leading arcuate portion 82 which is operatively connected to a trailing portion 84. The leading arcuate and trailing portions have opposed surfaces 86, 88 respectively which together define an arcuate opening 90. As can be seen in FIG. 4 the arcuate opening receives a strand 18 to be braided. Simultaneously, the twist compensator article by virtue of the arcuate opening prevents the strand 18 which is to be braided from twisting during pivoting of the braider carrier.

As can be appreciated the twist compensator article may be easily manufactured from a generally planar piece of material. The arcuate opening 90 may be machined from the center of the planar material so that the leading arcuate portion and trailing portion are actually connected to one another. Preferably the twist compensator article is made from metallic material; however it is contemplated within the scope of the invention that the twist compensator article may be made from plastics or ceramics as well. It is also within the scope of the invention to have the part manufactured by other methods such as punching or stamping.

It has been found that the twist compensator article is particularly useful when braiding pre-impregnated (i.e. prepreged) thermoplastic tows. These pre-preged tows are very stiff and are almost like steel strands. It would be highly undesirable to have the pre-preged tows twist during the braiding operation. It has been found that the twist compensator article is particularly useful in preventing this twisting from occurring.

It is preferred that at least a portion of the leading arcuate portion and trailing portion surfaces 86, 88 respectively is beveled. As shown in FIG. 4 only leading arcuate portion surface 86 is beveled. However it is within the scope of the invention to have the trailing portion surface 88 beveled as well. It has been found that the beveling of the leading arcuate portion surface is particularly advantageous in the movement of the strand over the twist compensator article. Additionally by beveling the leading arcuate portion surface a sharp edge is not presented to the strand which could under certain circumstances cause damage to the strand.

It is also preferred that the twist compensator article 80 lie in a plane generally parallel to the standard 44. When this is the case it can be seen that the twist compensator article 80 is generally perpendicular to the strand axis 18' and the arcuate opening is generally coincident with the strand axis 18'.

Figure 5:
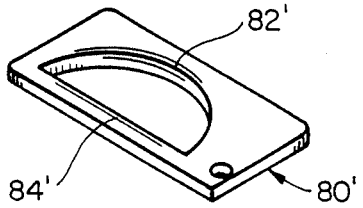
FIG. 5 is a perspective view of another embodiment of the twist compensator article.

FIG. 5 illustrates a slightly different embodiment of the twist compensator article 80'. In this case there is still a leading arcuate portion 82' and a trailing portion 84'. However the leading arcuate portion 82' is slightly different from the leading arcuate portion 82 as shown in FIG. 4. The main difference between the two twist compensator articles is that the twist compensator article in FIG. 5 may be somewhat simpler to machine. Otherwise the function of the twist compensator article in FIG. 5 is identical to that shown in FIG. 4.

The foregoing detailed description is illustrative of the embodiments of the invention. Variations and modifications will be apparent to those skilled in the art as fall within the scope of the appended claims.

What is claimed is:

1. A pivotable braider carrier comprising:

a frame;

a standard extending from said frame;

a bobbin rotatably mounted on said standard; and a twist compensator article operatively and directly connected to said frame, said twist compensator article hvaing a leading arcuate portion operatively connected to a straight trailing portion, said leading arcuate and trailing portions having opposed surfaces which together define an arcuate opening for receiving a strand to be braided and preventing a strand to be braided from twisting during pivoting of the braider carrier, said article being generally planar.

2. The braider carrier of claim 1 wherein at least a portion of said leading arcuate portion and trailing portion surfaces is beveled.

3. The braider carrier of claim 1 wherein said twist compensator article lies in a plane generally parallel to said standard.

4. A pivotable braider carrier comprising:

a frame;

a standard extending from said frame;

a bobbin rotatably mounted on said standard, said bobbin having end flanges;

magnetic clutch means rotatably mounted on said standard, said clutch means operatively magnetically engaging at least one end flange of said bobbin to resist rotation of said bobbin relative to said clutch means;

torsion spring means mounted about said standard and operatively interconnected between said magnetic clutch means and said frame, said spring means resisting and limiting rotation of said clutch means, said spring means capable of providing slack control of a strand to be braided and said clutch means capable of providing tension feed of a strand to be braided as a strand may be wound off of said bobbin; and a twist compensator article operatively connected to said frame, said twist compensator article having a leading arcuate portion operatively connected to a trailing portion, said leading arcuate and trailing portions having opposed surfaces which together define an arcuate opening for receiving a strand to be braided and preventing a strand to be braided from twisting during pivoting of the braider carrier.

5. The braider carrier of claim 4 wherein at least a portion of said leading arcuate portion and trailing portion surfaces is beveled.

6. The braider carrier of claim 4 wherein said twist compensator article lies in a plane generally parallel to said standard.

7. A braider carrier is in claim 4 wherein said magnetic clutch means includes a generally circular disc of low-friction material having at least one magnetic element secured thereto.

8. A braider carrier as in claim 7 wherein said disc is separated at the circumference thereof to define a plurality of radially projecting fingers, said at least one magnetic element connected to one of said fingers.

9. A braider carrier as in claim 8 wherein said disc includes a plurality of magnetic elements connected to a plurality of fingers, respectively.

* * * * *